US008007861B2

(12) United States Patent
Koizumi et al.

(10) Patent No.: US 8,007,861 B2
(45) Date of Patent: Aug. 30, 2011

(54) INK JET APPLICATOR

(75) Inventors: Hiroshi Koizumi, Hiratsuka (JP); Atsushi Kinase, Yokohama (JP); Taketo Shiba, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 667 days.

(21) Appl. No.: 12/176,435

(22) Filed: Jul. 21, 2008

(65) Prior Publication Data

US 2008/0284811 A1 Nov. 20, 2008

Related U.S. Application Data

(62) Division of application No. 11/292,369, filed on Dec. 2, 2005, now Pat. No. 7,481,512.

(30) Foreign Application Priority Data

Dec. 3, 2004 (JP) ..... 2004-351852

(51) Int. Cl.
*B05D 5/06* (2006.01)

(52) U.S. Cl. ..... 427/162; 427/108; 427/164

(58) Field of Classification Search ..... None
See application file for complete search history.

(56) References Cited

U.S. PATENT DOCUMENTS

| | | | |
|---|---|---|---|
| 5,412,411 | A | 5/1995 | Anderson |
| 5,559,536 | A | 9/1996 | Saito et al. |
| 5,847,728 | A | 12/1998 | Lee |
| 6,158,838 | A | 12/2000 | Capurso |
| 6,578,948 | B2 | 6/2003 | Shima |
| 6,736,484 | B2 | 5/2004 | Nakamura |
| 6,837,568 | B2 | 1/2005 | Nakamura |
| 7,093,924 | B2 | 8/2006 | Nakamura |
| 2003/0159651 | A1 | 8/2003 | Sakurada |
| 2006/0214987 | A1 | 9/2006 | Nakamura |
| 2007/0052751 | A1 | 3/2007 | Nakamura |
| 2007/0052753 | A1 | 3/2007 | Nakamura |

FOREIGN PATENT DOCUMENTS

| | | | | |
|---|---|---|---|---|
| CN | 2275519 | Y | | 3/1998 |
| JP | 8-150727 | | | 6/1996 |
| JP | 10003851 | A | * | 1/1998 |
| JP | 11268256 | A | * | 10/1999 |
| JP | 2003-245582 | | | 9/2003 |
| JP | 2003-284988 | | | 10/2003 |
| JP | 2003-340339 | | | 12/2003 |
| JP | 2004-111074 | | | 4/2004 |
| JP | 2004-127919 | | | 4/2004 |
| JP | 2004-230216 | | | 8/2004 |
| TW | 558508 | | | 10/2003 |

OTHER PUBLICATIONS

Machine translation of JP 2003-340339 A.*
Abstract of JP 10-003851 A.*
Abstract of JP 11-268256 A.*
Derwent abstract of JP 11-268256 A.*
Office Action issued Feb. 1, 2001 in Japan Application No. 2004-351852 (With English Translation).

* cited by examiner

*Primary Examiner* — Matthew Luu
*Assistant Examiner* — Justin Seo
(74) *Attorney, Agent, or Firm* — Oblon, Spivak, McClelland, Maier & Neustadt, L.L.P.

(57) ABSTRACT

An ink jet applicator includes an ink jet head having nozzle via which liquid droplets are jetted, a seal mechanism sealing the nozzle using a pressure vessel; a solution supply mechanism supplying a solution to the nozzle at a predetermined pressure.

4 Claims, 17 Drawing Sheets

INK JET APPLICATOR

CROSS REFERENCE TO RELATED APPLICATION

This application is a division of and claims the benefit of priority under 35 U.S.C. §120 from U.S. application Ser. No. 11/292,369, filed Dec. 2, 2005, and claims the benefit of priority under 35 U.S.C. §119 from Japanese patent Application No. 2004-351852, filed on Dec. 3, 2004, the entire contents of which are incorporated herein by reference.

BACKGROUND OF THE INVENTION

1. Field of the Invention

The present invention relates to an ink jet applicator which jets ink droplets onto an object.

2. Description of the Related Art

A personal computer or the like is provided with a liquid crystal display. The liquid crystal display includes a color filter in which minute liquid droplets of R (red), G (green) and B (blue) colors are sequentially jetted onto a transparent substrate using an ink jet applicator (refer to Japanese Patent Laid-Open Publication No. 2004-111074).

A light shield is arranged around a periphery of the color filter in order to block back light. A black ink is applied all over the light shield for this purpose, for example.

An ink jet applicator is used to form colored dots on the color filter and to blacken the light shield. The ink jet applicator includes ink jet heads having a plurality of nozzles, and jets inks onto target positions of a transparent substrate by moving the ink jet heads and the substrate.

With the ink jet applicator, a solution is filled into each ink jet head at a normal pressure, so that bubbles are formed in the ink. Such bubbles flow with the solution and accumulate in nozzles. In such a case, a pressure applied to the nozzles by piezoelectric elements will be absorbed by the bubbles, which prevents smooth jetting of the solution.

Further, liquid droplets applied onto the substrate or the like tend to dry when exposed in an open air. In such a case, the solution takes different times to dry at the periphery and center of the substrate. This means that the applied solution will have different levels of thickness.

BRIEF SUMMARY OF THE INVENTION

The present invention has been contemplated in order to overcome the foregoing problems of the related art, and is intended to provide an ink jet applicator which can reliably apply a liquid solution and control time to dry the applied solution.

According to a first aspect of the embodiment, there is provided an ink jet applicator which includes a plurality of ink jet heads in an outer bottom thereof, each ink jet head having a plurality of nozzles via which liquid droplets are jetted; a seal mechanism sealing the nozzles using a pressure vessel; and a solution supply mechanism supplying a solution to the nozzles at a predetermined pressure.

In accordance with a second aspect of the embodiment, there is provided an ink jet applicator which includes a liquid droplet jetting unit jetting liquid droplets onto an object via nozzles of ink jet heads; a cover extending over the liquid-droplet applied object and holding a solvent tank; and a solvent supply supplying the solvent into the solvent tank.

BRIEF DESCRIPTION OF THE SEVERAL THE DRAWINGS

DETAILED DESCRIPTION OF THE INVENTION

The invention will be described in detail with reference to the drawings.

First Embodiment

[Overall Configuration of Ink Jet Applicator]

Figure 1:
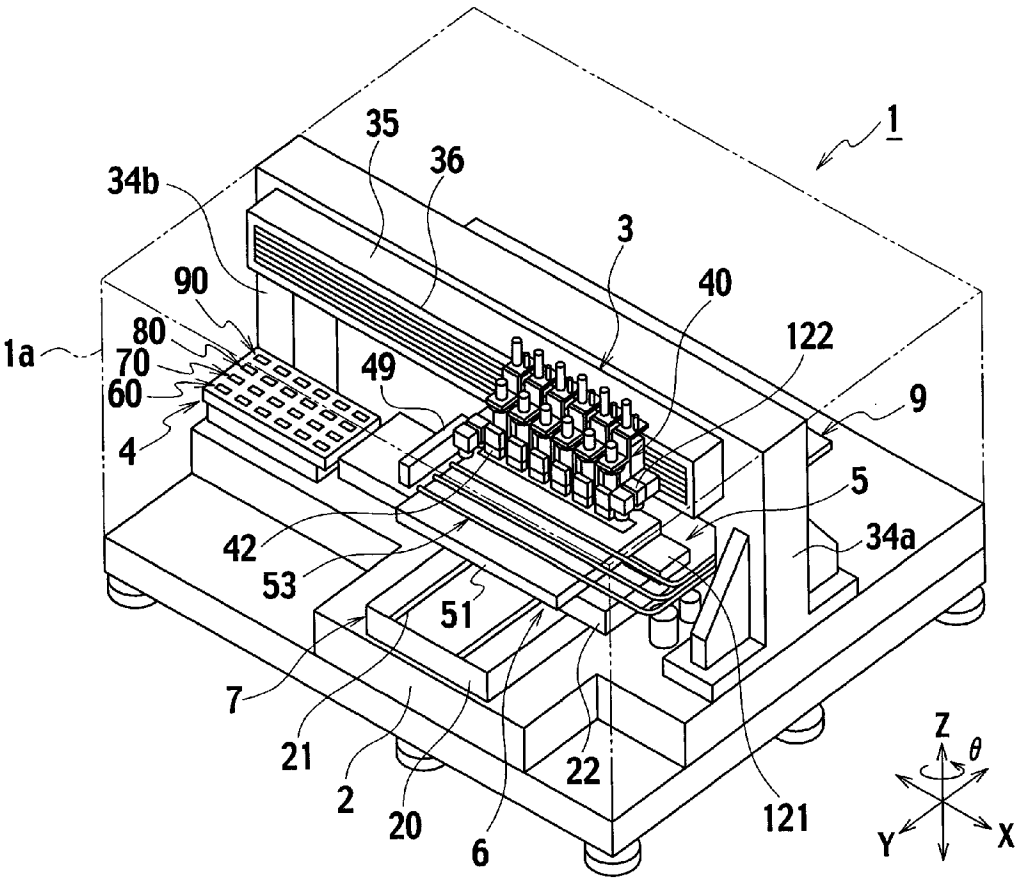
FIG. 1 is a perspective view of an ink jet applicator according to a first embodiment of the invention.

Referring to FIG. 1, an ink jet applicator 1 includes an ink applying unit 3; a maintenance unit 4; an inking position adjuster 5; a solvent humidity keeping unit 6; and a moving mechanism 7. The ink applying unit 3 applies ink droplets onto a substrate 30 using ink jet heads 42. The maintenance unit 4 keeps nozzles of the ink jet heads 42 from being dried in order to continuously jet ink droplets in a stable manner. The inking position adjuster 5 controls positions of ink droplets to be jetted. The solvent humidity keeping unit 6 extends over the substrate 30 where ink droplets are applied, and keeps ink droplets wet. The moving mechanism 7 moves a substrate table 33 in X and Y planes and rotates it in a θ direction. The substrate table 33 holds the substrate 30 in the ink applicator 3.

The ink jet applicator 1 is covered by a shield cover 1*a* in order to block ambient air.

Figure 2:
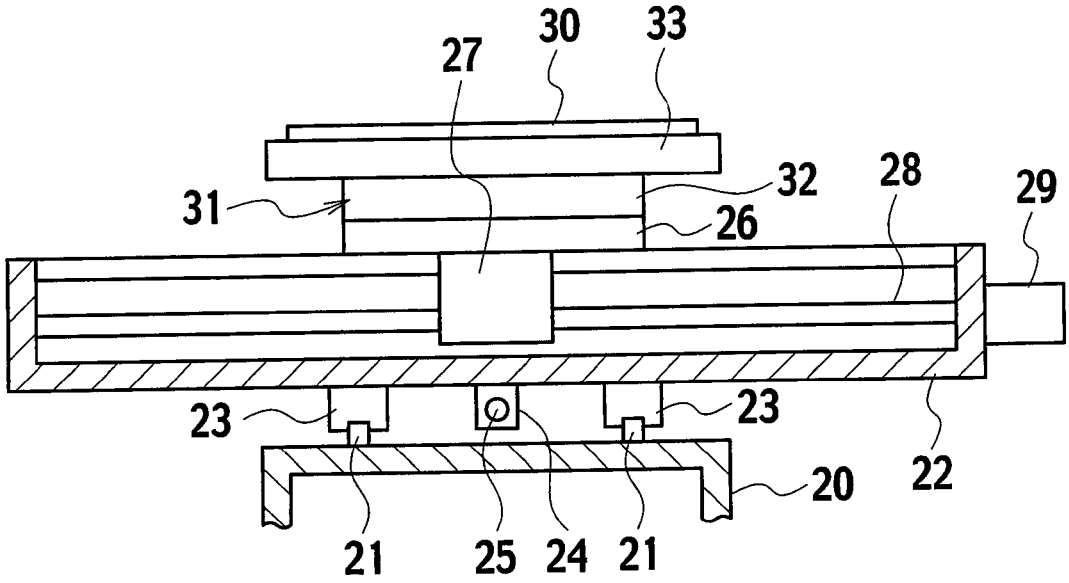
FIG. 2 is a cross-section of a substrate movable mechanism in the ink jet applicator of FIG. 1.

As shown in FIG. 2, the moving mechanism 7 includes a Y-axis guide plate 20 fixedly placed on a stand 2 (shown in FIG. 1), and a plurality of guide rails 21 provided on the Y-axis guide plate 20 and extending in the Y direction. The guide rails 21 are engaged with a guide 23 on a lower surface of a Y-direction movable table 22. The Y-direction movable table 22 is guided on the guide rails 21 and is freely movable in the Y direction. A projection 24 is provided on the lower surface of the Y-direction movable table 22. A feed screw 25 is attached to the projection 24, and is rotated by a Y-direction motor (not shown), which enables the Y-direction movable table 22 to move on the guide rails 21 in the Y direction.

A plurality of guide rails (not shown) are arranged on the Y-direction movable table 22, extend in the X direction, and are engaged with a guide (not shown) on a lower surface of an X-direction movable table 26. The X-direction movable table 26 is freely movable in the X direction. The X-direction movable table 26 has a projection 27 on its lower surface. A feed screw 28 is attached to the projection 27, and enables the X-direction movable table 26 to move on the guide rails in the X direction when rotated by an X-direction motor 29.

A θ-direction rotating mechanism 31 has a bearing provided on the upper surface of the X-direction movable table 26, and enables a housing 32 to be rotatable with respect to the Y-direction movable table 26. The housing 32 is movable in the θ-direction by a drive mechanism constituted by a θ-direction rotatable motor (not shown). The substrate table 33 is positioned on the X-direction movable table 26, and supports the housing 32, and is movable in the direction θ by the drive mechanism constituted by the θ-direction rotatable motor in response to the rotation of the housing 32.

The substrate table 33 attracts and holds the substrate 30 in response to the operation of a vacuum adsorbing mechanism (not shown).

A moving distance of the substrate table 33 in the X direction can be detected on the basis of an output pulse signal from an X-direction encoder (not shown). Further, a moving distance of the substrate table 33 in the Y direction can be detected on the basis of an output pulse signal from a Y-direction encoder (not shown). Still further, a rotational extent of the substrate table 33 in the θ direction can be detected on the basis of an output pulse signal from a θ-direction encoder (not shown).

A substrate delivery/reception unit 9 is provided on the rear surface of the ink jet applicator 1, receives fresh substrates 30 from a substrate storage (not shown), places them on the substrate table 33, and returns the inked substrates 30 to the substrate storage.

Referring to FIG. 1, ink jet head units 40 are positioned above the stand 2 in the ink applying unit 3, and are movable in X and Y directions, and in a Z direction which is perpendicular to the X and Y directions.

In the ink applying unit 3, a pair of columns 34*a* and 34*b* are upright on the stand 2, and the Y-direction guide plate 20 are positioned between them. An X-direction guide plate 35 spans across upper parts of the columns 34*a* and 34*b*.

A guide mechanism 36 extends in the X direction in front of the X-direction guide plate 35, and supports the ink jet head units 40 in such a manner that they are movable in the X direction.

Figure 3:
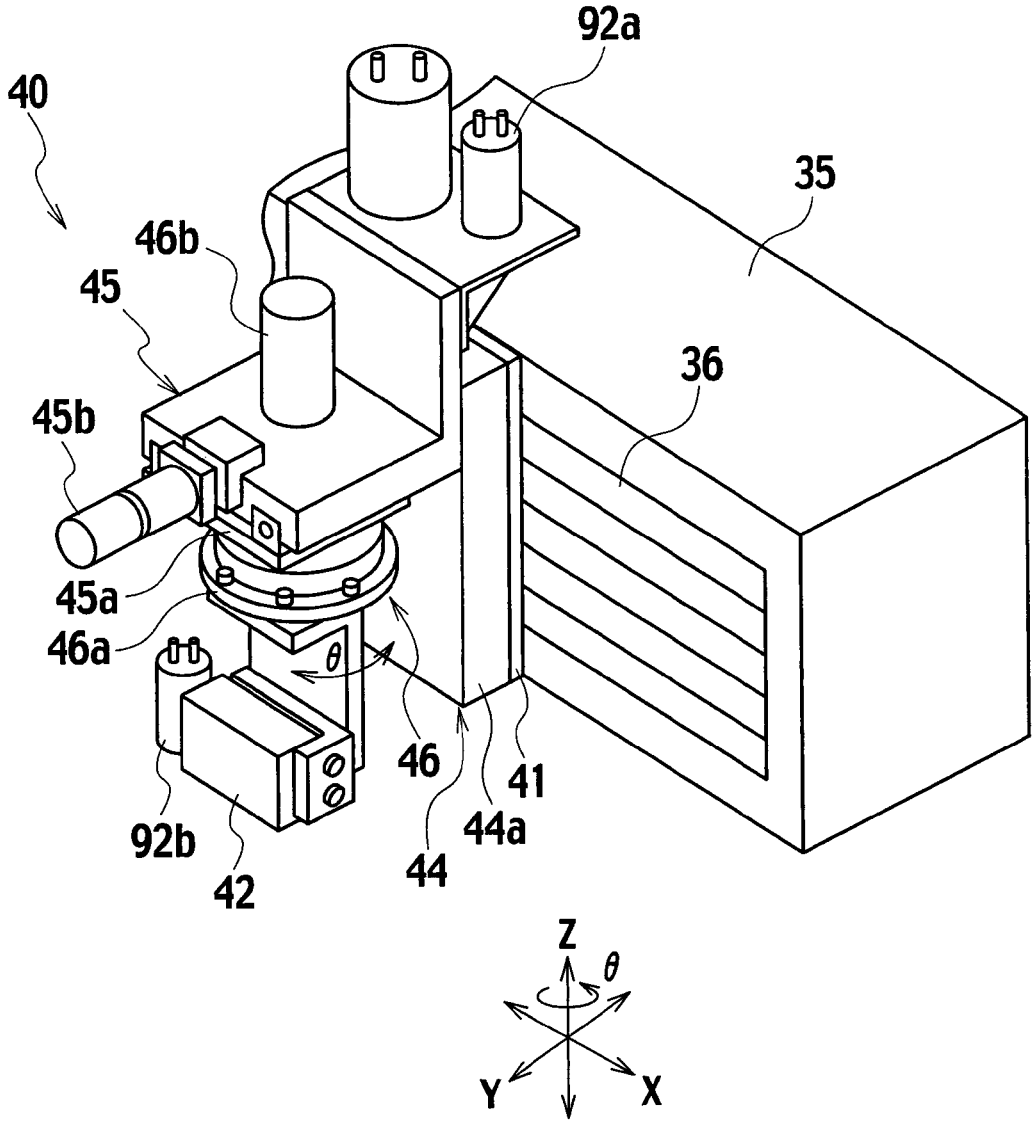
FIG. 3 is a perspective view of an ink jet head unit of the ink jet applicator of FIG. 1.

Referring to FIG. 3, a base plate 41 where the ink jet head units 40 stand upright is engaged with the guide mechanism 36. The base plate 41 is moved in the X direction along the guide mechanism 36 by a drive mechanism constituted by a head unit moving motor (not shown). A moved distance of the base plate 41 can be detected on the basis of a pulse-shaped output signal produced by the X-direction encoder (not shown).

In the ink applying unit 3, a control unit 10 controls not only the operation of the ink jet applicator 1 but also the movement of the Y-direction table 22 in the Y direction and the movement of the X-direction table 26 and the base plate 41 in the X direction, and diversely changes relative positions of the substrate 30 (on the substrate table 33) and the ink jet head units 40.

The ink jet head units 40 jet inks downward via ink jet heads 42. All of the ink jet head units 40 have the same structure.

Referring to FIG. 3, each ink jet head unit 40 includes a Z-direction movable mechanism 44, a Y-direction movable mechanism 45, a θ-direction rotating mechanism 46, and an ink jet head 42. The Z-direction movable mechanism 44 is attached on the base plate 41, and supports a movable part 44*a*, which is movable in the Z direction (vertically). The Y-direction movable mechanism 45 is supported by the movable part 44*a* of the Z-direction movable mechanism 44, and supports a movable part 45*a*, which is movable in the Y direction. The θ-direction rotatable mechanism 46 supports a rotatable part 46*a* which is supported by the movable part 45*a* and is rotatable in the θ direction. The θ direction is present around the center of the Z direction. The ink jet heads 42 vertically hang from the θ-direction rotatable mechanism 46 toward the rotatable part 46*a*. The Z-direction movable mechanism 44 can control height of the ink jet heads 42 in the Z direction with respect to the substrate 30. The Y-direction movable mechanism 45 controls the position of the ink jet heads 42 in the Y direction with respect to the substrate 30. The θ-direction rotatable mechanism 46 rotates the ink jet heads 42 in the θ direction with respect to the substrate 30. The Y-direction movable mechanism 45 and the Z-direction movable mechanism 44 are provided with a Y-direction head adjusting actuator 45*b* and a Z-direction head adjusting actuator 44*b*, respectively. The actuators 45*b* and 44*b* are motors or the like, and are used to move the ink jet heads 42 in the Y and Z directions. Further, the θ-direction rotatable mechanism 46 includes a θ-direction rotatable actuator 46*b*, which is a motor or the like, and rotates the ink jet heads 42 in the θ direction. Moving distances of the ink jet heads 42 in the Y and Z directions and a rotational extent of the ink jet heads 42 are detected on the basis of pulse-shaped signals produced by the Y-direction and Z-direction encoders (not shown) and the θ-direction encoder (not shown).

In the ink jet head units 40, the positions of the ink jet heads 42 can be differently controlled with respect to the substrate table 33.

Figure 4:
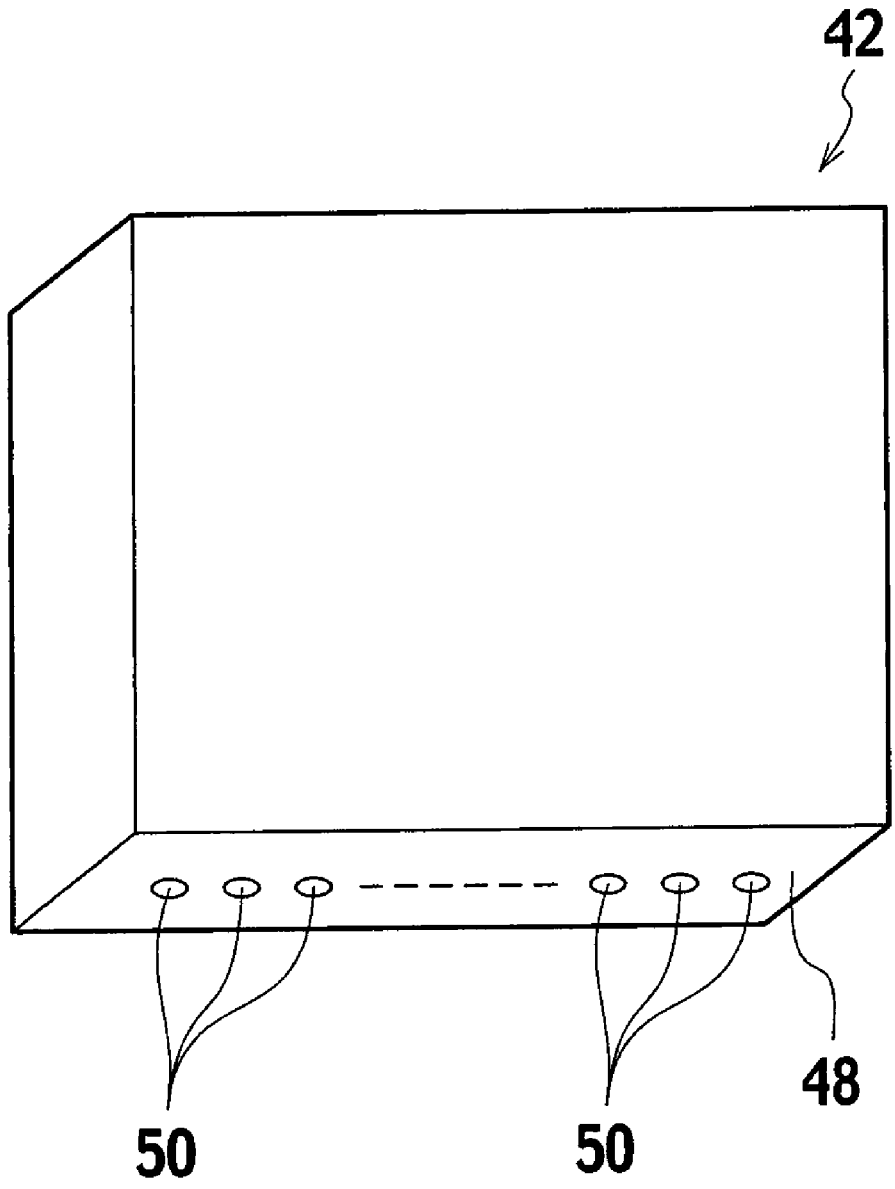
FIG. 4 is a perspective view of an ink jet head of the ink jet applicator of FIG. 1.

Referring to FIG. 4, each ink jet head 42 has a number of nozzles 50 in its outer bottom 48 (called the "outer bottom 48 of the ink jet head 42" hereinafter). The nozzles 50 are aligned and are equally spaced.

Each ink jet head 42 has an ink reservoir communicating with the nozzles 50. Diaphragms and piezoelectric elements are provided at an upper part of the ink reservoir for the respective nozzles 50. When the piezoelectric element is actuated in response to an injection control signal from the control unit 10, a pressure in the ink reservoir is changed, so that ink will be jetted from the ink reservoir via the nozzles 50. The ink jetted downward via the nozzle 50 is applied onto the upper surface of the substrate 30 on the substrate table 33.

[Configuration of Solvent Humidity Keeping Unit]

The solvent humidity keeping unit 6 (shown in FIG. 1) is positioned above the substrate table 33 in the ink applying unit 3, and includes the cover 51, solvent keeper 52 (shown in FIG. 6), and solvent supply 53. The cover 51 extends over the substrate 30 on the substrate table 33 with a space. The solvent keeper 52 is housed in the cover 51 and is made of an non-woven fabric or the like. The solvent supply 53 feeds the solvent to the solvent keeper 52.

Figure 5:
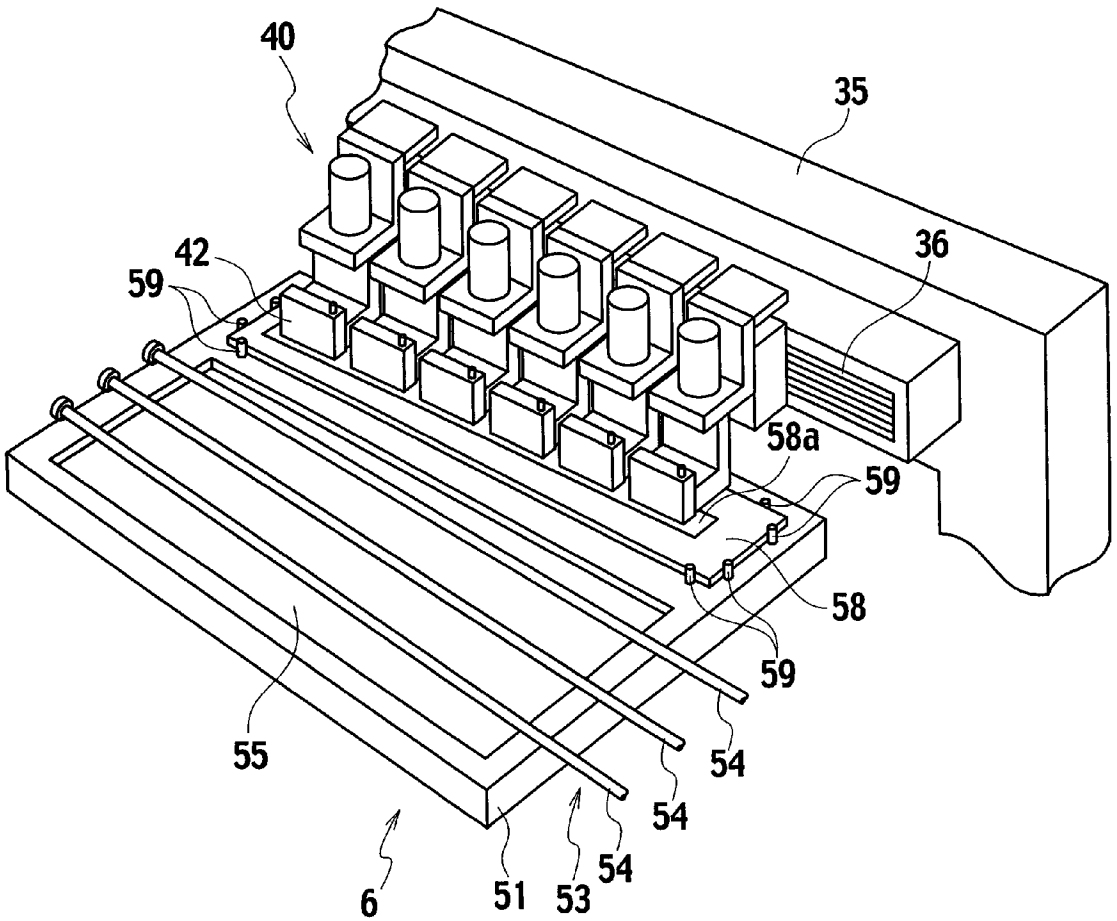
FIG. 5 is a perspective view of a solvent humidity maintaining unit of the ink jet applicator of FIG. 1.
Figure 6:
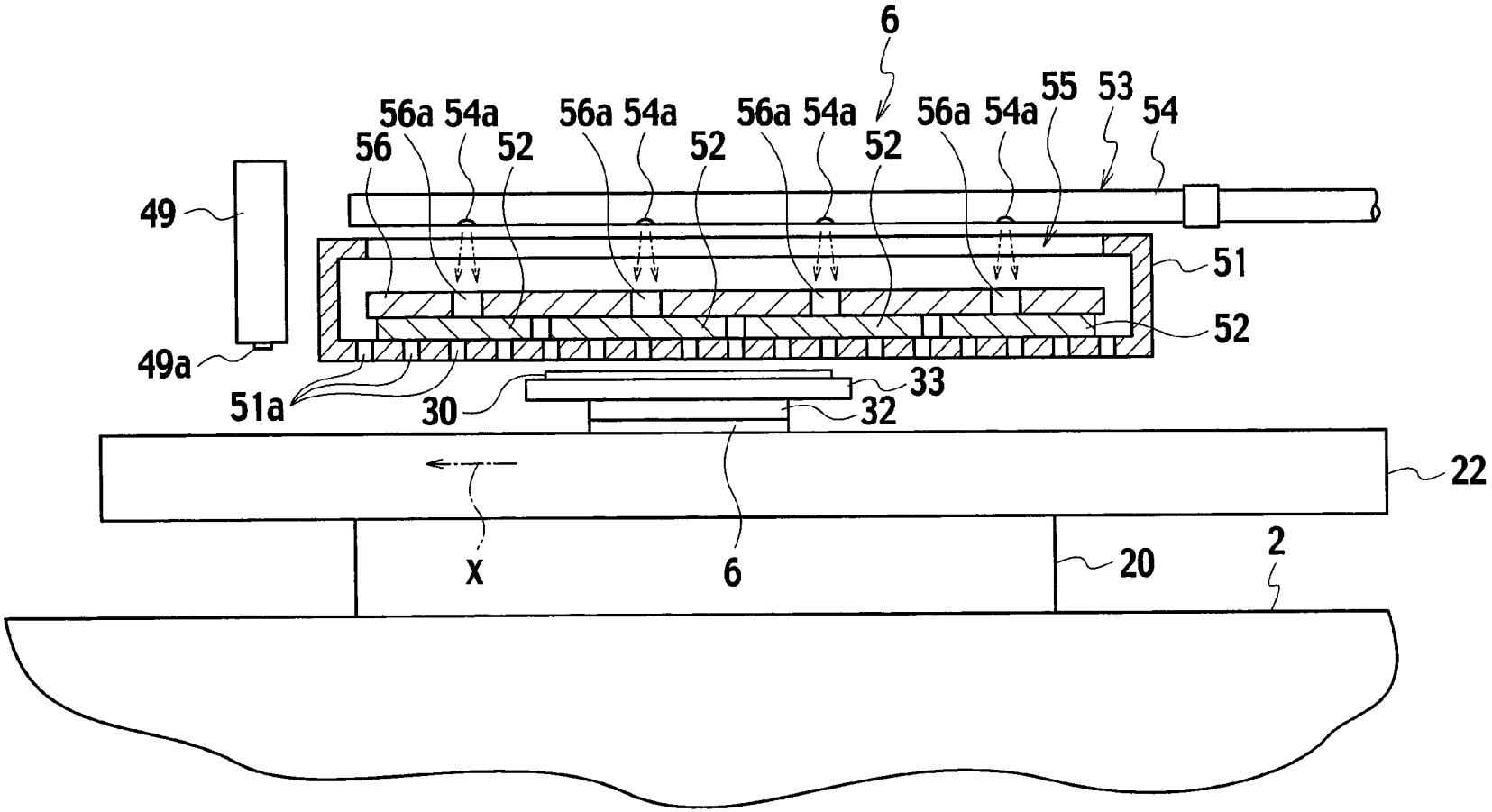
FIG. 6 is a cross-section of the solvent humidity maintaining unit of FIG. 5.

As shown in FIG. 5 and FIG. 6, the cover 51 is in the shape of a box, and is fixedly attached to the stand 2 of the ink jet applicator 1 using a support (not shown). Further, the cover 51 has an opening 55 on its upper surface. The solvent supply 53 is positioned over the opening 55, and includes a plurality of cylindrical tubes 54. Each cylindrical tube 54 has a downward spout 54*a*. The solvent fed into the cylindrical solvent tube 54 is downwardly jetted via the spout 54*a*, and is supplied into the cover 51 via the opening 55.

The box-shaped cover 51 houses the solvent keeper 52 on its inner bottom. A flat plate 56 is placed on the solvent keeper 52, and has a plurality of through-holes 56*a*. The solvent jetted via the cylindrical tube 54 is fed to the solvent keeper 52 via the through-holes 56*a*, and is absorbed in the solvent keeper 52. The flat plate 56 suppresses evaporation of the solvent absorbed in the solvent keeper 52.

The cover 51 has a number of through-holes 51*a* in the bottom thereof. The solvent in the solvent keeper 52 evaporates downward via the through-holes 51*a*. In the space under the cover 51, humidity of ink droplets applied onto the substrate 30 is maintained by the solvent evaporated downwardly from the cover 51, which prevents ink droplets from being dried on the substrate 30.

Figure 7:
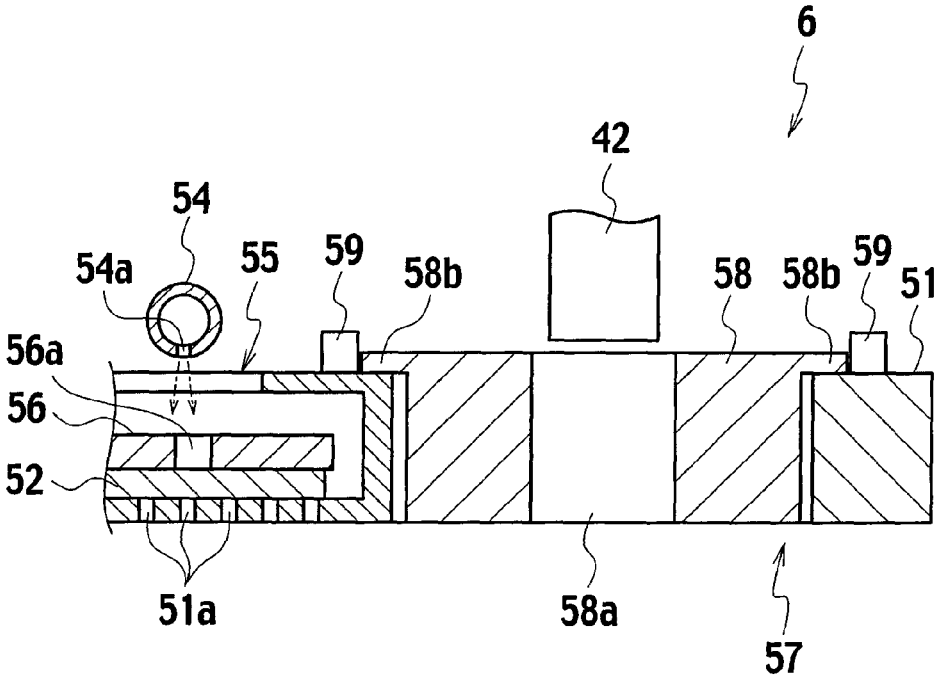
FIG. 7 is a further cross-section of the solvent humidity maintaining unit of FIG. 5.

Referring to FIG. 7, the cover 51 has openings 57 at positions facing with the ink jet heads 42. Adaptors 58 are inserted and retained in the openings 57. The adaptors 58 are provided with flanges 58*b*, which are placed on the cover 51, so that the adaptors 58 extend over the openings 57 of the cover 51. Further, the cover 51 has positioning pins 59 on the upper surface thereof. The positioning pins 59 keep the adaptors 58 at predetermined positions.

Each adaptor 58 has an opening 58*a*, via which the ink droplets pass downward from the ink jet head 42. The openings 58*a* are differently shaped for respective adaptors 58. This is because substrates have different sizes and areas to be inked. In order to cope with this situation, the ink jet heads 42 have to be moved in the X direction by the X-direction movable mechanism (X-direction guide plate 35). When a plurality of the ink jet heads 42 are arranged with wide spaces kept between them, the opening 58*a* of the adaptors 58 should be large. Conversely, the narrower the spaces between the ink jet heads 42, the smaller the spaces between the openings 58*a* of the adaptors 58. The size of each opening 58*a* is set to be minimum for the ink droplets to pass there through, which is effective in maintaining the solvent humidity at the lower part of the cover 51. Therefore, a plurality of adaptors 58 having different sizes are prepared, and appropriate adaptors 58 will be selected in accordance with the substrate 30 to be inked. This is effective in preferably maintaining the solvent humidity depending upon the substrates 30.

As shown in FIG. 1 and FIG. 6, a blow unit 49 is provided on the stand 2 beside the solvent humidity keeping unit 6, and is supported by a supporter (not shown). Specifically, the blow unit 49 is positioned above the movable area of the substrate table 33. Nitride gases or the like are injected from a gas source (not shown) via gas nozzles 49*a*, and are supplied onto the whole area of the substrate 30 on the substrate table 33, which is positioned below the blow unit 49. The number of gas nozzles 49*a* depend upon the size of the substrate table 33. The blow unit 49 injects gases onto the inked substrate 30, and enables the ink droplets on the substrate 30 to be quickly and overall dried.

[Configuration of Maintenance Unit]

The maintenance unit 4 is positioned on the stand 2 of the ink jet applicator 1 as shown in FIG. 1, and includes an immersing unit 60, a solvent injecting unit 70, a wiping unit 80 as a cleaning mechanism, and a bubble remover 90. The immersing unit 60 immerses the outer bottoms 48 of the ink jet heads 42 in an ink solution. The solvent injecting unit 70 jets solvent droplets onto the outer bottoms 48 of the ink jet heads 42. The wiping unit 80 wipes the outer bottoms 48 of the ink jet heads 42. The bubble remover 90 supplies the ink solvent to the ink jet heads 42, and removes bubbles from the nozzles 50.

Each ink jet head 42 is moved in the X, Y and Z directions by the X-direction movable mechanism, Y-direction movable mechanism and Z-direction movable mechanism, so that the ink jet head 42 is moved to face with the immersing unit 60, solvent injecting unit 70, wiping unit 80 or bubble remover 90.

Figure 8B:
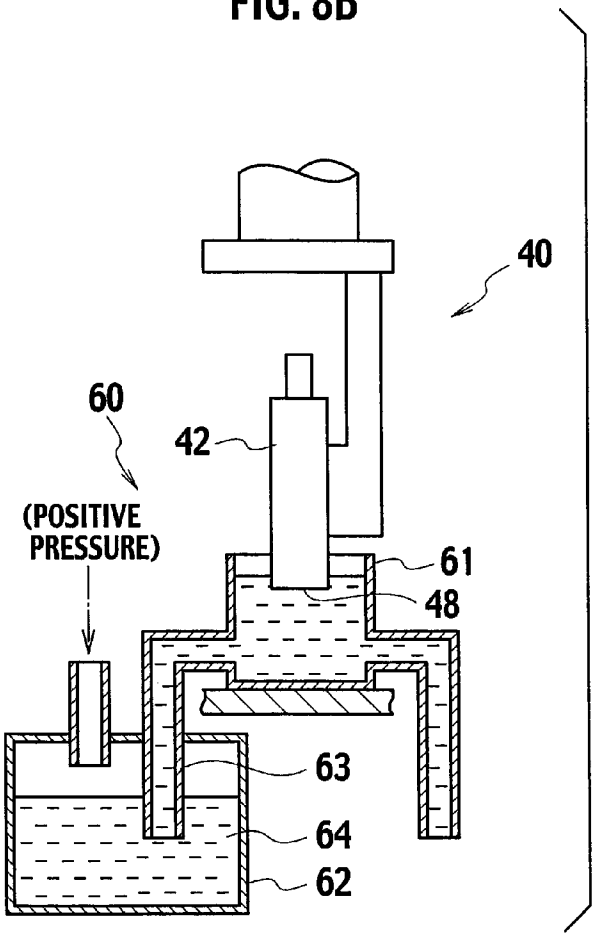
FIG. 8A and FIG. 8B are cross-sections of an immersing unit of the ink jet applicator of FIG. 1.
Figure 8A:
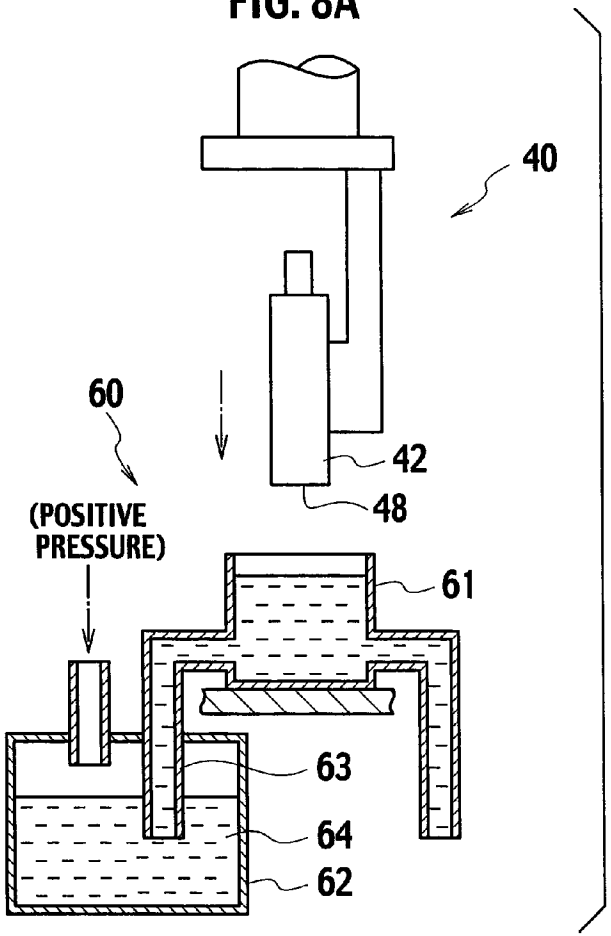

Referring to FIG. 8A, the immersing unit 60 is constituted by a solution bath 61 and a solution tank 62. The solution tank 62 stores the solution 64 therein, and supplies it to the solution bath 61 via a supply pipe 63 when a positive pressure is applied from an external unit.

When the solution is filled in the solution bath 61, the outer bottom 48 of the ink jet head 42 is moved to the position above an opening on the solution bath 61 by the X- and Y-direction movable mechanism 45 (shown in FIG. 3). Thereafter, the outer bottom 48 of the ink jet head 42 is descended by the Z-direction movable mechanism 44 (shown in FIG. 3), and is immersed in the solution 64 in the solution bath 61. Thus, the nozzles 50 will be kept wet on the outer bottom 48 of the ink jet head 42. Refer to FIG. 8B.

Figure 9B:
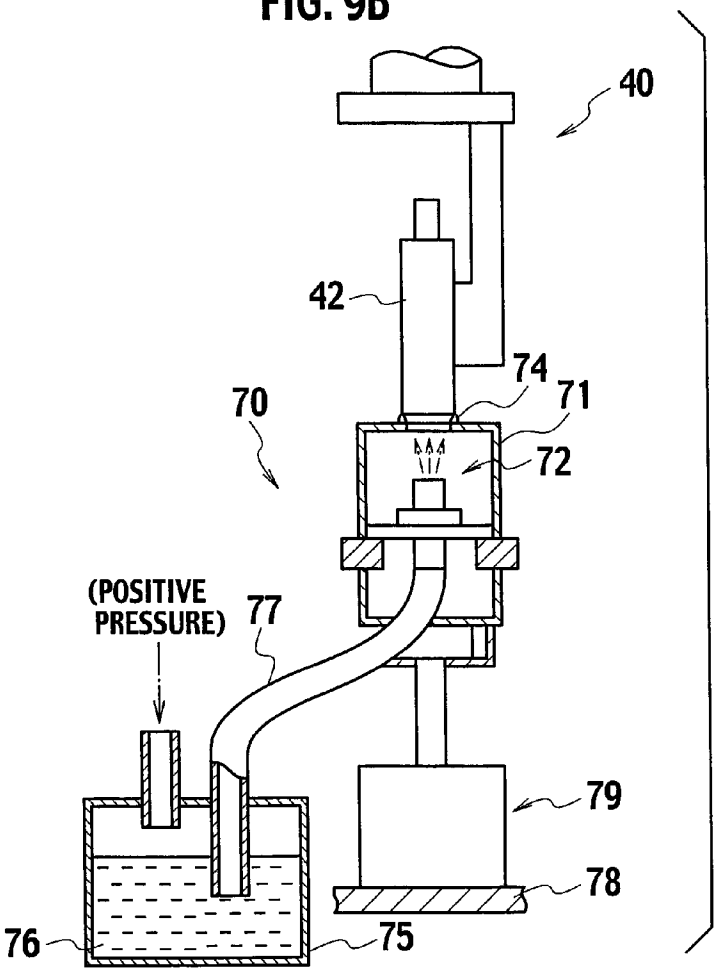
FIG. 9A and FIG. 9B are cross-sections of a solvent injector of the ink jet applicator of FIG. 1.
Figure 9A:
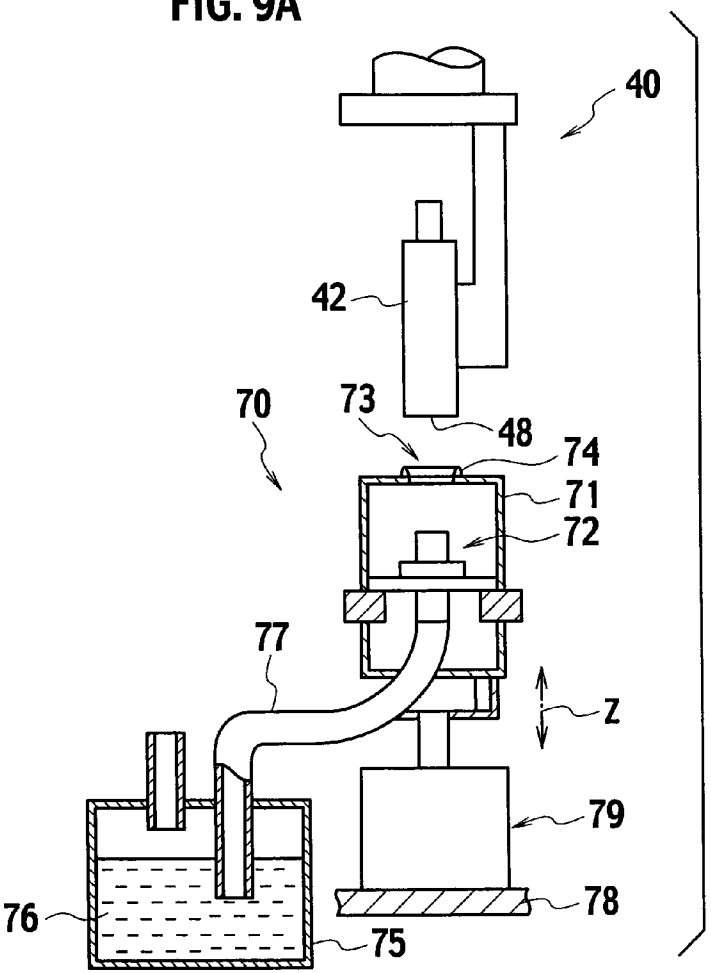

As shown in FIG. 9A, the solvent injecting unit 70 includes a container 71, a solvent injector 72 housed in the container 71, and a solvent tank 75 storing a solvent 76 which is identical to the ink solvent to be injected to the solvent injecting unit 72. The solvent tank 75 stores the solvent 76 therein, and supplies it to the solvent injector 72 via a supply pipe 77 when a positive pressure is applied from an external source.

The container 71 housing the solvent injector 72 is moved up and down in the Z direction by an actuator 79 fixedly attached to a support frame 78. The container 71 has an opening 73 on its upper part. The opening 73 is oriented in the solvent injecting direction of the solvent injector 72. A gasket 74 is provided on an outer surface of the container 71, and surrounds the opening 73.

Once the outer bottom 48 of the ink jet head 42 is positioned above the opening 73 of the container 71 by the X- and Y-direction movable mechanism 45, the container 71 is moved upward by the actuator 79. Thus, the outer bottom 48 of the ink jet head 42 faces with the opening 73 via the gasket 74. In this state, the solvent 76 is supplied to the solvent injector 72 from the solvent tank 75. The solvent 76 is then jetted onto the outer bottom 48 of the ink jet head 42 via the opening 73, so that the outer bottom 48 of the ink jet head 42 is cleaned by the solvent 76.

Figure 10B:
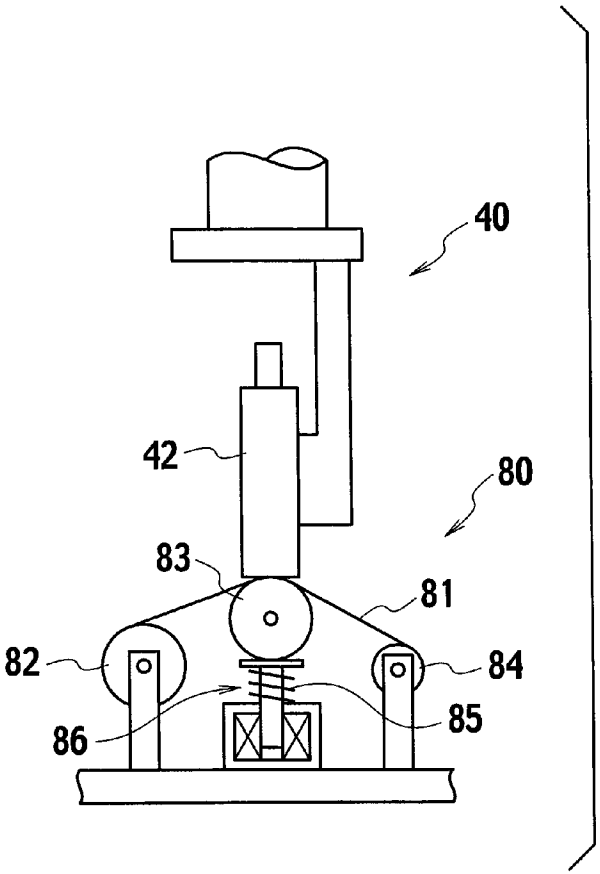
FIG. 10A and FIG. 10B are cross-sections of a wiper of the ink jet applicator of FIG. 1.
Figure 10A:
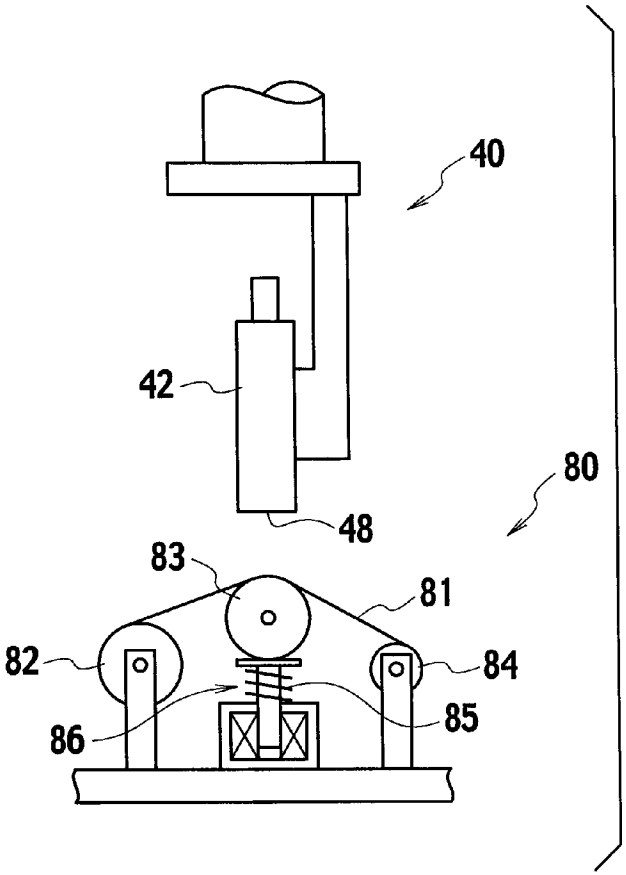

Referring to FIG. 10A, the wiping unit 80 is a part of the maintenance unit 4 (shown in FIG. 1), and is constituted by a feed roller 82, a guide roller 83, a take-up roller 84, and a tension mechanism 86. The feed roller 82 has a non-woven fabric 81 wrapped thereon. The guide roller 83 positions the non-woven fabric 81 fed from the feed roller 82. The take-up roller 84 is rotated by a drive mechanism (not shown) using a motor, and takes up the non-woven fabric 81. The tension mechanism 86 biases the guide roller 83 upward using a spring 85.

When the non-woven fabric 81 is positioned by the guide roller 53, the outer bottom 48 of the ink jet head 42 is moved above the guide roller 53 by the X- and Y-direction movable mechanism 45 (shown in FIG. 3), and is then descended by the Z-direction movable mechanism 44 (shown in FIG. 3). Thereafter, the outer bottom 48 of the ink jet head 42 is brought into contact with the non-woven fabric 61 as shown in FIG. 10B. In this state, the take-up roller 84 is rotated to feed the non-woven fabric 81, which is moved to the take-up roller 84 via the guide roller 83. This enables the non-woven fabric 81 to wipe the outer bottom 48. The outer bottom 48 is made free from the solvents (solutions), foreign objects and so on.

Figure 11:
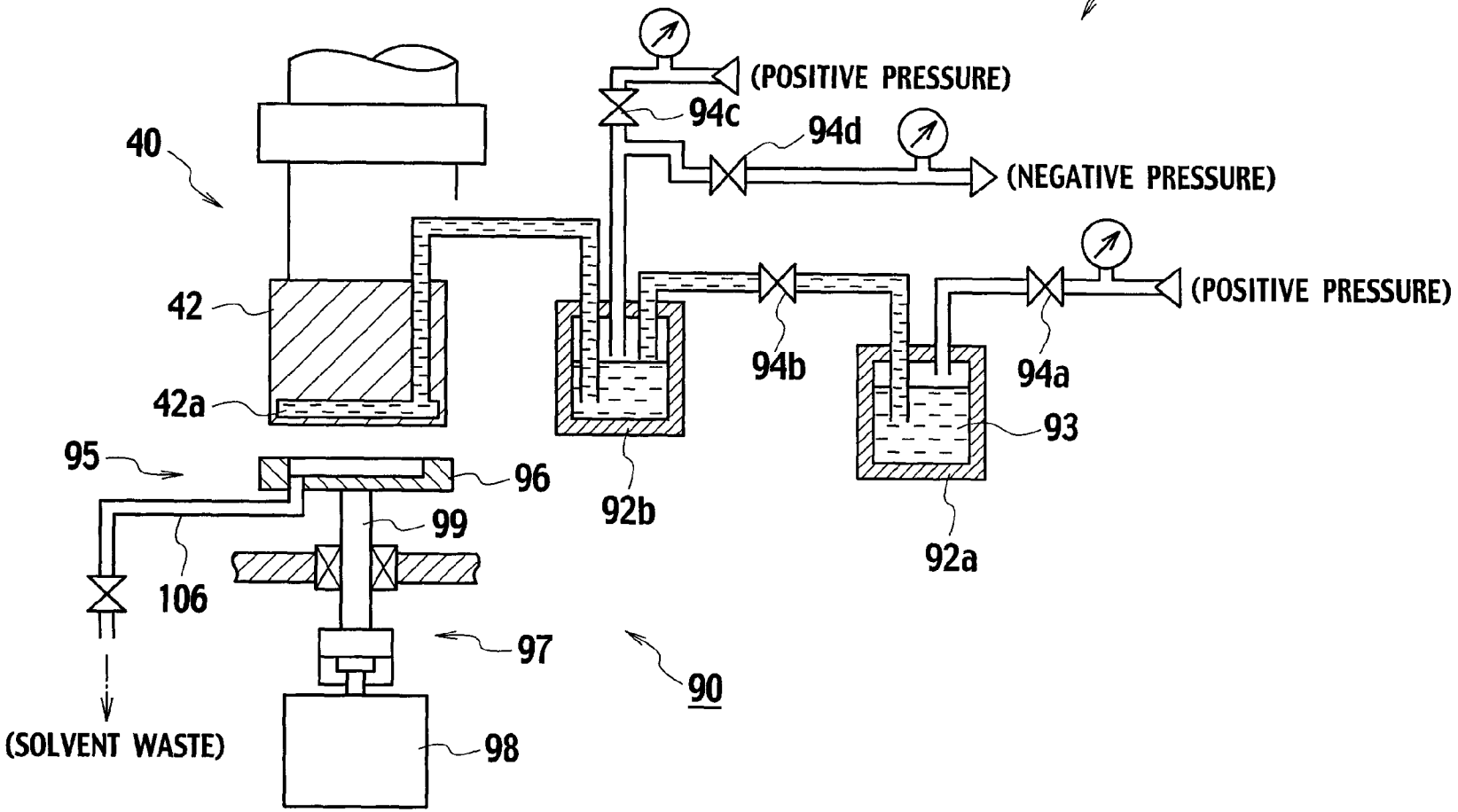
FIG. 11 is a side elevation of a bubble remover of the ink jet applicator of FIG. 1.

Referring to FIG. 11, the bubble remover 90 includes solution feed units 91 and sealing units 95, both of which are provided for respective ink jet heads 42. Each solution feed unit 91 feeds the solution to each ink jet head 42. Each sealing unit 95 seals each outer bottom 48 of the ink jet head 42.

Each solution feed unit 91 is constituted by a solution tank 92*a* storing a solution 93, and an intermediate tank 92*b* controlling a feeding pressure of the solution to the ink jet head 42. The solution feed unit 91 feeds the solution 93 to the intermediate tank 92*b* via a valve 94*b* when a positive pressure is applied to the solution tank 92*a* via a valve 94*a*.

When a further positive pressure is applied via a valve 94*c*, the intermediate tank 92*b* feeds the solution 93 to the ink jet head 42. The pressure inside the intermediate tank 92*b* is adjusted in accordance with the positive pressure applied via the valve 94*c*, and is reduced in accordance with a negative pressure applied via the valve 94*d*.

Each ink jet head 42 includes the ink reservoir 42*a*, of which pressure is controlled by the solution feed unit 91.

Each sealing unit 95 includes a pressure vessel 96 sealing the outer bottom 48 of the ink jet head 42, and a lift mechanism 97. The lift mechanism 97 moves the pressure vessel 96 up and down via a support 99 in response to the vertical movement of the actuator 98. This is because the support 99 which is moved up and down by the actuator 98 holds the lift mechanism 97.

Figure 12:
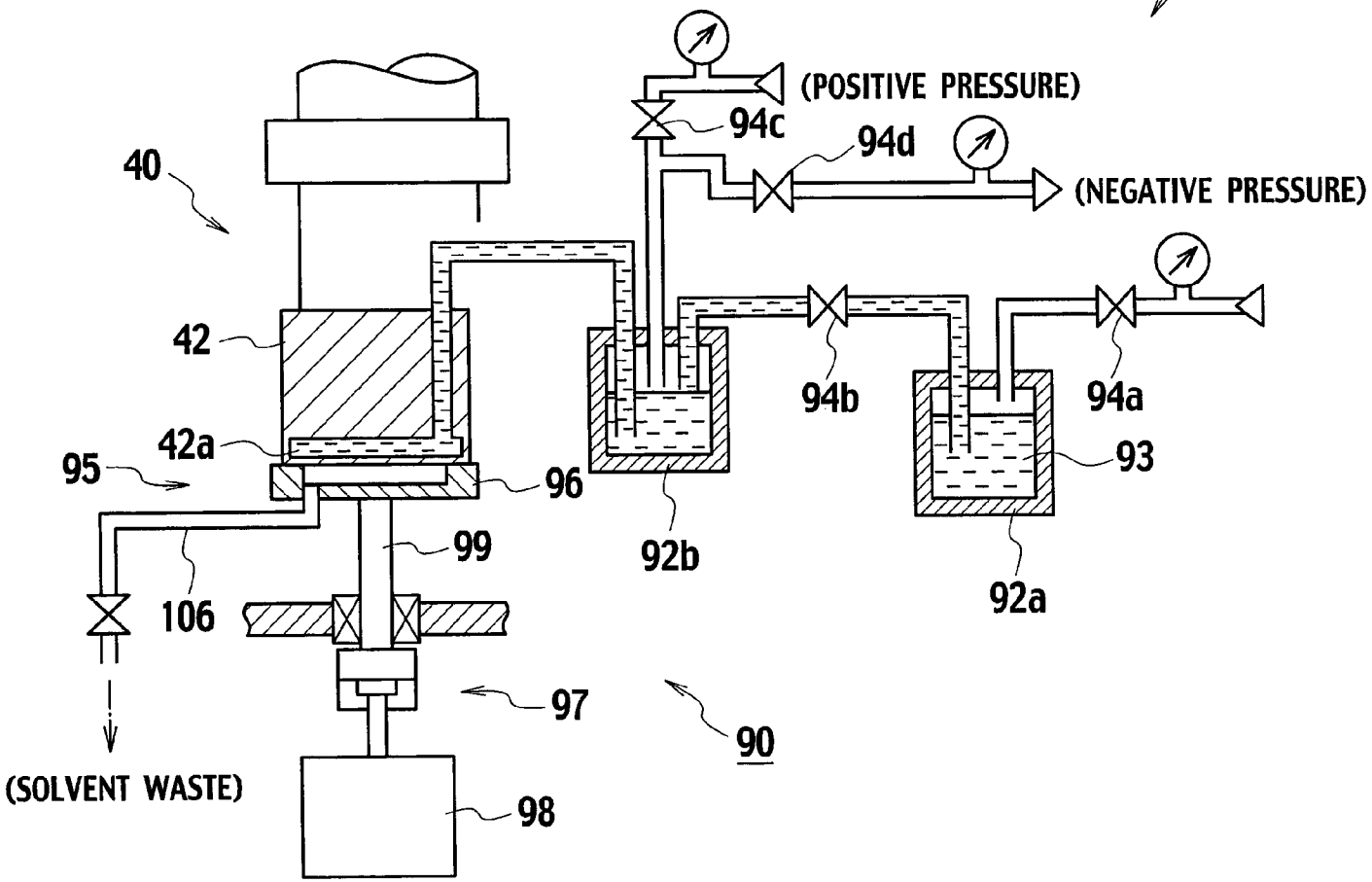
FIG. 12 is a cross-section of the bubble remover of the ink jet applicator of FIG. 1.

When the ink jet head 42 is positioned above the bubble remover 90 as shown in FIG. 12, the pressure vessel 96 is moved upward by the actuator 98, so that the outer bottom 48 is sealed by the pressure vessel 96.

Figure 13:
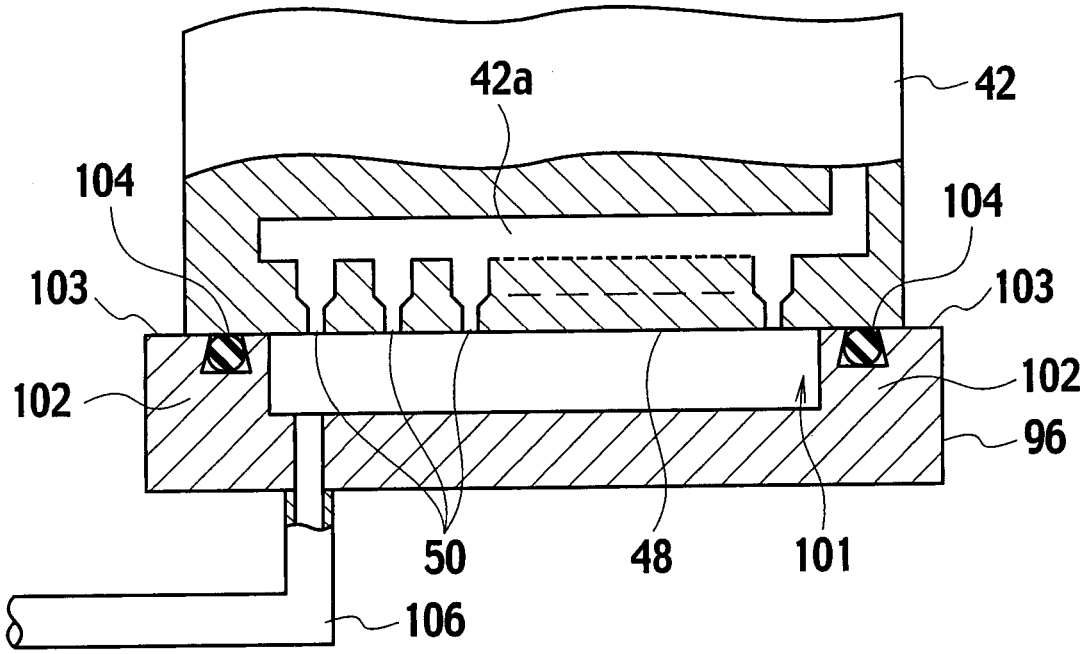
FIG. 13 is a further cross-section of the bubble remover of FIG. 11, showing the detailed structure thereof.

As shown in FIG. 13, a drainage 101 is provided above the pressure vessel 96. An upper peripheral edge 103 of a side wall 102 of the drainage 101 is brought into contact with the outer bottom 48 of the ink jet head 42, so that the outer bottom 48 is sealed by an inner surface and bottom of the drainage 101. A gasket 104 is provided on the upper peripheral edge 103 of the pressure vessel 96, and is brought into contact with the outer bottom 48 of the ink jet head 42, thereby sufficiently sealing the outer bottom 48.

In the foregoing state, the solution feed unit 91 feeds the solution 93 to the ink reservoir 42*a* of the ink jet head 42 under a certain pressure, which raises the pressure in the ink reservoir 42*a*.

Figure 14:
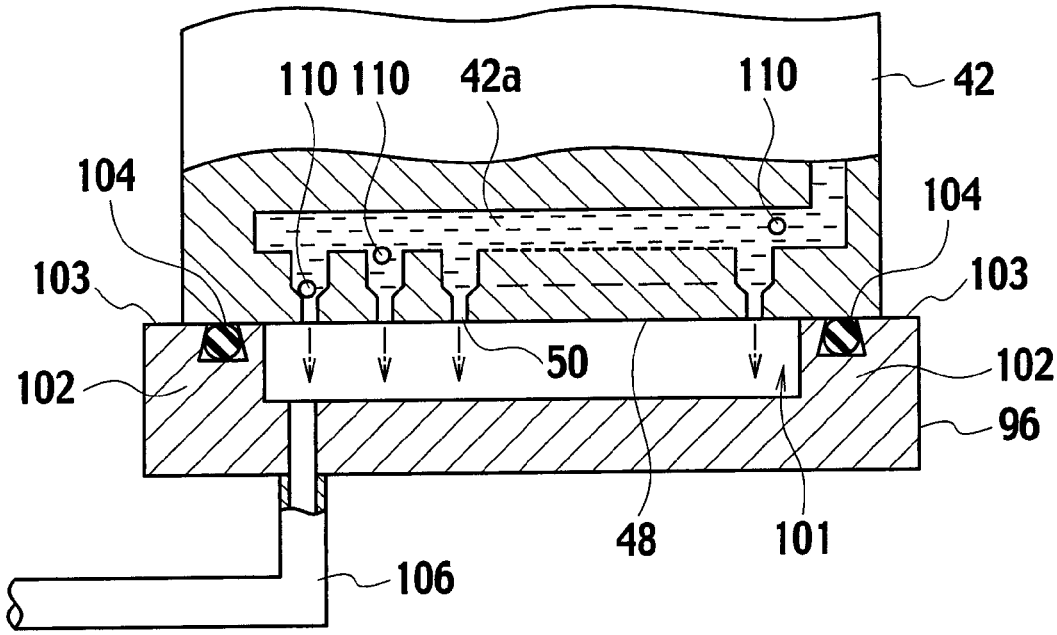
FIG. 14 is a still further cross-section of the bubble remover of FIG. 11, showing the detailed structure thereof.

When the pressure in the in reservoir 42*a* is raised as described above and as shown in FIG. 14, bulk of bubbles 110 in the ink can be reduced, and will be discharged into the drainage 101 together with the solution via the nozzles 50. The solution sent to the drainage 101 will be expelled outward via a drain pipe 106.

In the ink jet applicator 1, when filling the ink solution in the ink jet heads 42, the ink reservoirs 42*a* of the ink jet heads 42 are high-pressured by the bubble remover 90 in order to remove bubbles from the ink solution. Therefore, the nozzles 50 are protected against insufficient ink jetting due to bubbles.

[Configuration of Inking Position Adjuster]

Referring to FIG. 1, the inking position adjuster 5 includes a temporary inking stage 121, and an image pickup unit 122 which takes images of ink droplets on the temporary inking stage 121.

The temporary inking stage 121 is positioned on the Y-direction movable table 22, and is movable in the X direction on the rails extending in the X direction, in response to the operation of the X-direction motor 29. Relative movement of the ink jet heads 42 and the temporary inking stage 121 enables the ink jet heads 42 to apply ink droplets onto a paper sheet (not shown) on the temporary inking stage 121. The temporary inking stage 121 and the Y- and X-direction movable mechanism constitute a temporary inking unit.

The image pickup unit 122 is movable in the X direction in response to the operation of the guide mechanism 36 on the front surface of the X-direction guide plate 35. Specifically, the image pickup unit 122 is moved in the X direction in response to the operation of a head unit moving motor on the guide mechanism 36.

The control unit 10 (to be described later and shown in FIG. 15) stores in a memory 17 reference inking position data representing positions to be inked on the temporary inking stage 121. The control unit 10 relatively moves the temporary inking stage 121 and the ink jet heads 42, and moves the ink jet heads 42 to the reference position, so that ink droplets will be jetted onto the target positions on the paper sheet on the temporary inking stage 121.

The control unit 10 (as an adjusting unit) moves the image pickup unit 122, which takes images of ink droplets on the paper sheet. The control unit 10 detects the position where ink has been applied on the basis of the images picked up by the image pickup unit 122. On the basis of the detected results, the control unit 10 adjusts the X-, Y-, Z- and θ-directions of the ink jet head 42.

With the ink jet applicator 10, amounts of ink droplets to be jetted via the respective nozzles 50 are controlled in addition to the control of the inking positions. Specifically, the image pickup unit 122 takes images of diameters of ink droplets landing onto the temporary inking stage 121. The control unit 10 measures the diameters of ink droplets, varies voltages to be applied to piezoelectric elements of the respective nozzles 50, thereby changing sizes of droplets. Further, the control unit 10 checks nozzles 50 from which no ink droplets are jetted, on the basis of the picked up images.

[Configuration of Control Unit]

Figure 15:
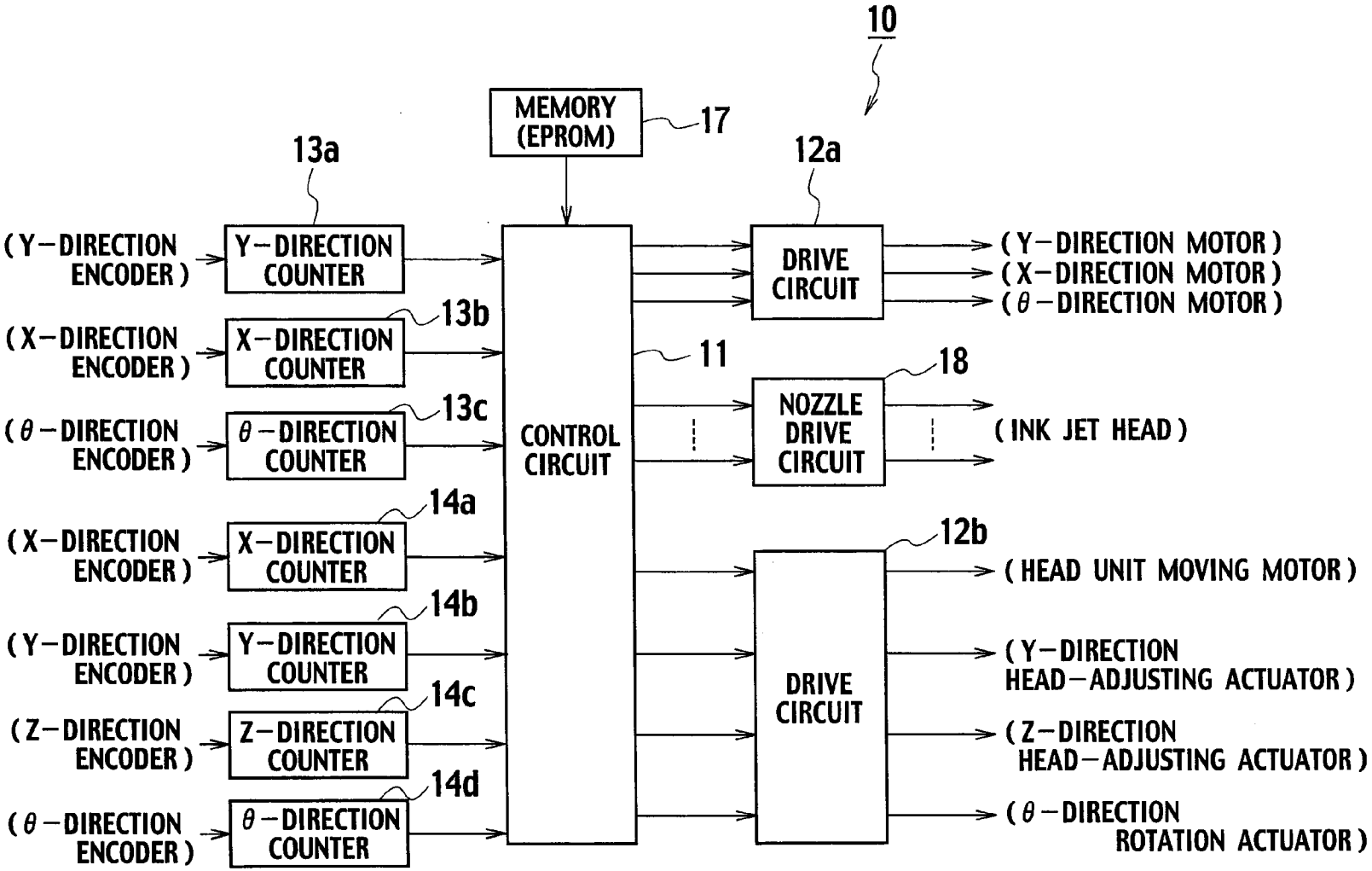
FIG. 15 is a block diagram of a control unit of the ink jet applicator of FIG. 1.

Referring to FIG. 15, the control unit 10 includes a control circuit 11 in order to control not only the movement of the substrate table 26 and the ink jet heads 42 but also ink jetting of the ink jet heads 42. The control circuit 11 is connected to the X-direction moving motor 29 (shown in FIG. 2) moving the substrate table 33, drive circuit 12*a* for the Y- and θ-direction motors, head unit moving motor for the ink jet heads 42, Y-direction head adjusting actuator 45*b*, and drive circuit 12*b* for the Z- and θ-direction head adjusting actuator 46*b*.

The control unit 10 also includes a Y-direction counter 13*a* and an X-direction counter 13*b*, which count pulses produced by the Y- and X-direction encoders. When the counters 13*a* and 13*b* count a predetermined number of pulses, they send count result signals to the control circuit 11. Further, the control circuit 10 includes a θ-direction counter 13*c* which counts the number of pulses from a θ-direction encoder in order to detect a rotational extent of the substrate table 33 in the θ direction. The θ-direction counter 13*c* sends a count result signal to the control circuit 11 when the predetermined number of pulses are counted.

The control circuit 11 can check whether or not the substrate table 33 moves by the predetermined distance in response to the drive signals to the motors, on the basis of the count result signals from the Y- and X-direction counters 13*a* and 13*b*. Further, the control circuit 11 can confirm whether or not the substrate table 33 rotates by the predetermined extent, on the basis of the count result signal from the θ-direction counter 13*c*.

In order to detect the moving distance of the ink jet heads 42, the control unit 10 further includes an X-direction counter 14*a*, a Y-direction counter 14*b* and a Z-direction counter 14*c* for the X-direction encoder, Y-direction encoder and Z-direction encoder. These counters produce and send count result signals to the control circuit 11 when they count the predetermined numbers of pulses from the foregoing encoders. Still further, the 10 is provided with a θ-direction counter 14*d* in order to detect a rotational extent of the ink jet heads 42 in the θ direction. The θ-direction counter 14*d* sends a count result signal to the control circuit 11 when it counts a predetermined number of pulses.

The control circuit 11 judges, on the basis of the count result signals produced by the X-direction counter 14*a*, Y-direction counter 14*b*, and Z-direction counter 14*c*, whether or not the ink jet heads 42 have moved by the predetermined distances in response to the drive signals to the motors activating the ink jet heads 42. Further, the control circuit 11 judges whether or not the ink jet heads 42 have rotated by the predetermined extent, on the basis of the count result signal from the θ-direction counter 14*d*.

Further, the control circuit 11 is connected to a memory unit 17, which stores data on voltage waveforms to be applied to piezoelectric elements of the ink jet heads 42 and parameters of ink jetting conditions for the respective ink jet heads 42. The memory unit 17 stores the foregoing data in correspondence with dot position data, and is preferably a rewritable EPROM (erasable-programmable ROM).

An amount of ink droplets to be jetted via each nozzle of each ink jet head 42 can be controlled by varying the voltage waveform applied to the piezoelectric element. Therefore, data on an optimum amount of ink droplet are stored in the memory unit 17.

A nozzle drive circuit 18 is connected to the control circuit 11 in order to apply voltages to the piezoelectric elements of the nozzles of the ink jet head 42. The control circuit 11 reads voltage waveform data which are stored in the memory unit 17 and correspond to ink applying positions (ink dot positions), and sends the read data to the nozzle drive circuit 18 when the relative positions of the ink jet heads 42 and the substrate 30 agree with the ink applying positions. The nozzle drive circuit 18 produces voltages in accordance with the voltage waveform data, and supplies them to the nozzles 50. In this state, the ink jet heads 42 jet the ink onto the ink applying positions of the substrate 30 via the nozzles 50.

With the ink jet applicator 1, the control unit 10 prevents unsuccessful injection of ink droplets by letting the bubble remover 90 remove bubbles in the ink jet heads 42 when the ink solution is filled in the ink jet heads 42.

Once the ink jet heads 42 are filled with the ink solution, the control unit 10 introduces the substrates 10 to be inked into the ink applying unit 3 via the substrate delivery/reception unit 9.

When inking is completed on the substrate 30, the control unit 10 lets the immersing unit 60 put the outer bottoms 48 of the ink jet heads 42 into the immersing bath 61, thereby preventing the nozzles 50 from being dried. When resuming to ink the substrate 30, the control unit 10 pulls the ink jet heads 42 from the immersing bath 61, lets the ink injecting unit 70 inject the solvents onto the outer bottoms 48 of the ink jet heads 42, and makes the wiping unit 80 take the solvents or foreign objects from the outer bottom surfaces 48. In this manner, the outer bottoms 48 of the ink jet heads 42 are cleaned.

Thereafter, the control unit 10 adjusts inking positions of the ink jet heads 42 using the inking position adjuster 5. If no ink jetting is confirmed by the inking position adjuster 5, the control unit 10 again cleans the outer bottoms 48 of the ink jet heads 42 using the solvent jetting unit 70 and the wiping unit 80.

In this state, ink droplets will be stably jetted via the nozzles 50. Thereafter, the control unit 10 operates the movable mechanism 7 in order to control the relative position of the substrate table 33 and the ink jet heads 42, so that the ink will be applied onto the target positions of the substrate 30. During the inking process, the solvent humidity keeping unit 6 over the substrate 30 prevents the ink on the substrate 30 from being dried. After the inking, the control unit 10 lets the blow unit 49 jet a gas such as a nitride gas onto the substrate 30, thereby drying the ink on the substrate 30.

When the inking process is completed, the control unit 10 discharges the inked substrate 30 via the substrate delivery/reception unit 9.

With the ink jet applicator 1, when the ink solution is filled in the ink reservoirs 42 of the ink jet heads 42, the bubble remover 90 raises the pressure in the ink reservoirs 42*a* in order to remove bubbles from the ink solutions. In this state, no bubbles will remain in the nozzles 50, which prevents malfunction of the nozzles 50 due to bubbles.

Once a fresh substrate 30 is placed on the substrate table 33, the control unit 10 moves the substrate table 33 below the ink jet heads 42. The solvent humidity keeping unit 6 is positioned between the ink jet heads 42 and the substrate 30, and keeps the ink droplets wet on the substrate 30.

The ink droplets remain wet on the substrate 30, and are reined to be naturally and non-uniformly dried. Therefore, the control unit 10 can reliably and easily control drying of the ink droplets using a drier. Further, the inked substrate 30 is quickly dried by the blow unit 49, which is effective in unifying the thickness of the inks all over the substrate 30.

The ink jet applicator 1 of the foregoing embodiment can stably apply liquid droplets, and reliably control drying of the ink solution.

Other Embodiments

Figure 16B:
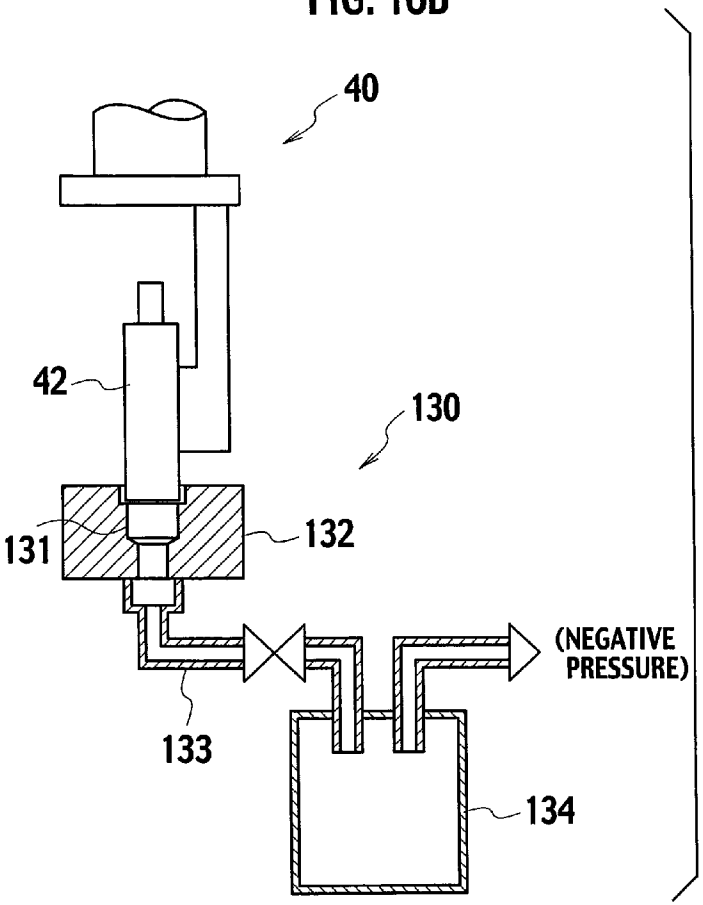
FIG. 16A and FIG. 16B are cross-sections of a suction unit in a further embodiment of the invention.
Figure 16A:
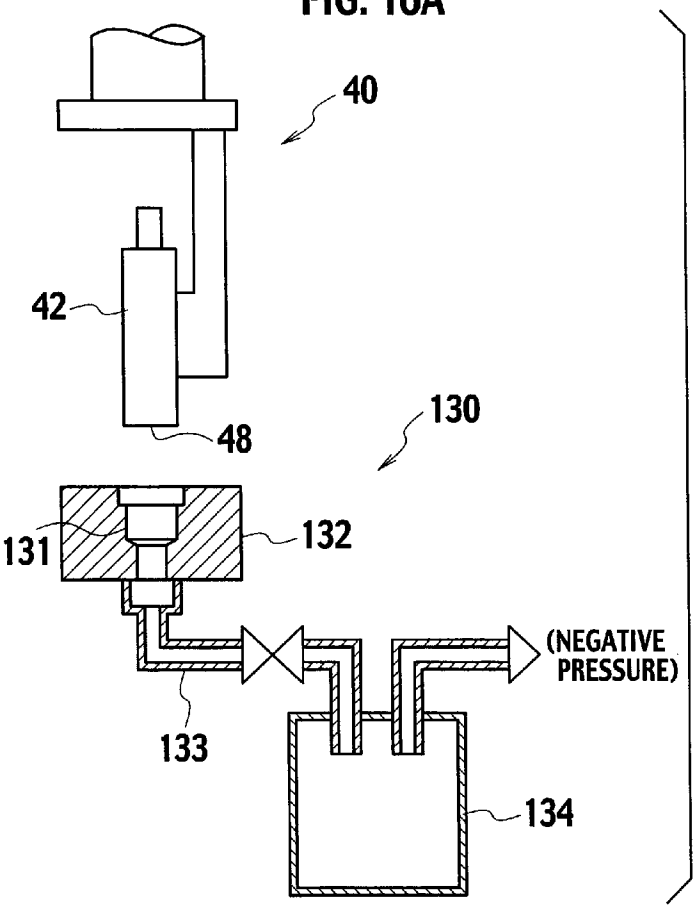

In the foregoing embodiment, the wiping unit 80 as a cleaning mechanism removes solvents or foreign objects from the outer bottoms 48 of the ink jet heads 42. Alternatively, the maintenance unit 4 (shown I FIG. 1) may include a suction section 130 as its one part in order to suck solvents (solutions) or foreign objects from the outer bottoms 48 of the ink jet heads 42. Referring to FIG. 16A, the suction section 130 is constituted by a suction unit 132 having a suction opening 131, and a suction tank 134 applying a negative pressure into the suction opening 131. The suction tank 134 communicates with a lower part of the suction opening 131. A negative pressure is applied into the opening 131 from an external device via a suction pipe.

An upper part of the suction opening 131 is slightly larger than the outer bottom 48 of the ink jet head 42, so that the outer bottom 48 is put into the opening 131. In other words, the drive mechanism using the head unit moving motor and the Y-direction movable mechanism 45 (shown in FIG. 2) of ink jet head units 40 position the outer bottoms 48 of the ink jet heads 42 above the suction opening 131. Thereafter, the ink jet head 42 is moved downward by the Z-direction movable mechanism 44 of the ink jet head unit 40, so that the outer bottom 48 is inserted into the upper part of the suction opening 131. In this state, a minute gap is present between an inner wall of the suction opening 131 and a side surface of the ink jet head 42, so that air will be introduced into the suction opening 131 through the minute gap. This enables solvents (solutions) or foreign objects to be removed from the outer bottom 48 of the ink jet head 42 similarly to being wiped by the wiping unit 80 (shown in FIG. 10).

Figure 17B:
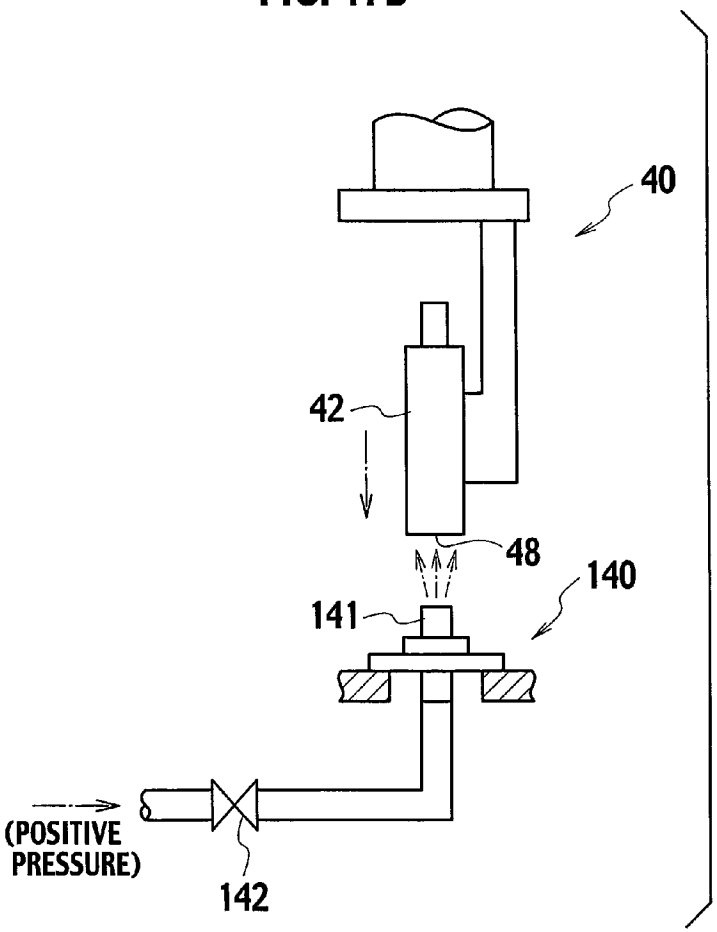
FIG. 17A and FIG. 17B are side elevations of a gas injector in the further embodiment of the invention.
Figure 17A:
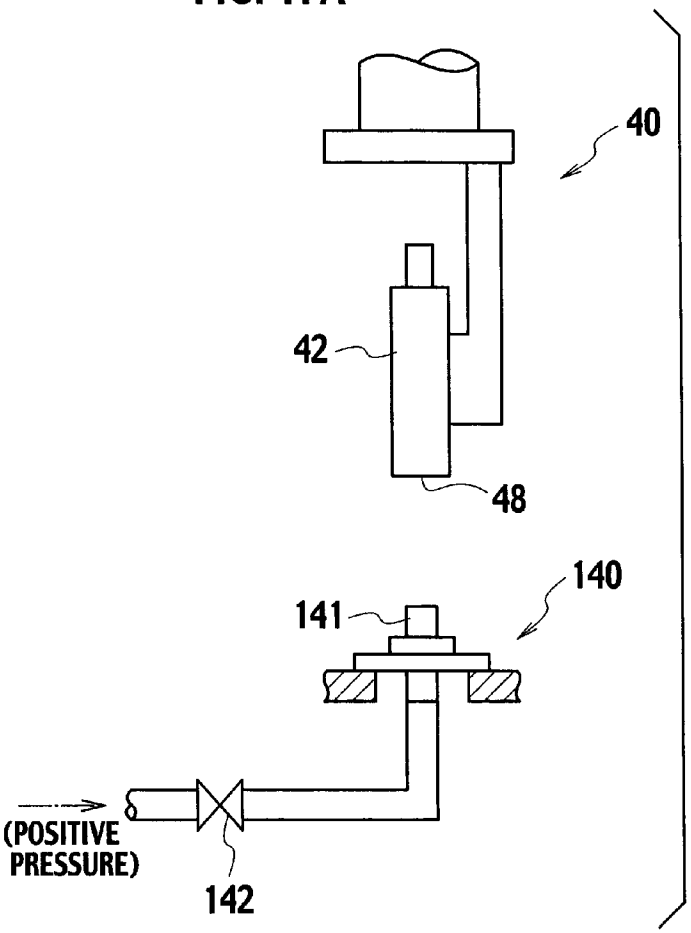

Further, air or gases may be blown onto the outer bottom 48 of the ink jet head 42 in order to remove solvents (solutions) or foreign objects there from in place of using the wiping unit 80. For instance, a gas blower 140 is provided as a part of the maintenance unit 4 (shown in FIG. 1), and blows air or gas onto the outer bottom 48 of the ink jet head 42. The gas blower 140 includes a valve 142 blowing air or gases into a gas nozzle 141. When the outer bottom 48 of the ink jet head 42 is positioned above the gas nozzle 141 by the foregoing movable mechanisms (shown in FIG. 2), the outer bottom 48 of the ink jet head 42 is brought close to the gas nozzle 141 as shown in FIG. 17(B). In this state, the valve 142 is opened in order to blow air or gases onto the outer bottom 48 of the ink jet head 42, so that ink or foreign objects can be removed from the outer bottom 48 similarly to the wiping unit 80 (shown in FIG. 10).

Still further, two or more of the wiping unit 80, suction section 130 and gas blower 140 may be used in combination.

For instance, a cap may be provided and is movable between a position over the outer bottom 48 of the ink jet head 42 and a position off from the outer bottom 48. The cap may cover the outer bottom 48 when no inking is performed, thereby keeping the nozzle 50 wet.

What is claimed is:

1. An ink jet applicator comprising:

an ink applying unit which includes an ink jet head having nozzles to jet solution droplets therethrough to an object;

a cover which covers the object, and comprises a container portion in which a non-woven fabric capable of keeping a liquid solvent is housed, a communicating portion through which a space in the container communicates with an outside thereof, the communicating portion being disposed, facing the object, between the ink jet head and a table on which the object is placed; and a solvent supply which supplies the non-woven fabric with the liquid solvent.

2. The ink jet applicator according to claim 1, wherein the communicating portion comprises a plurality of through-holes arranged over the object.

3. The ink jet applicator according to claim 1, wherein the solvent supply comprises a solvent supply pipe having solvent spouts.

4. The ink jet applicator according to claim 1, further comprising a blow unit which blows a gas to the object.

* * * * *